US007013854B1

(12) United States Patent
Heintzen et al.

(10) Patent No.: US 7,013,854 B1
(45) Date of Patent: Mar. 21, 2006

(54) DEVICE FOR THE HYDRAULIC ADJUSTMENT OF THE ANGLE OF ROTATION OF A CAMSHAFT IN RELATION TO A CRANKSHAFT OF AN INTERNAL COMBUSTION ENGINE

(75) Inventors: Dirk Heintzen, Weisendorf (DE); Jochen Auchter, Weisendorf (DE); Ahmet Deneri, Wiesenttal (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/131,569

(22) Filed: May 18, 2005

(51) Int. Cl.
*F01L 1/34* (2006.01)

(52) U.S. Cl. ..... 123/90.15; 123/90.17; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 5,301,639 A * 4/1994 Satou ..... 123/90.17
5,988,126 A * 11/1999 Strauss et al. ..... 123/90.17
6,129,060 A * 10/2000 Koda ..... 123/90.17

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

A device (1) for the hydraulic adjustment of the angle of rotation of a camshaft (3) in relation to a crankshaft of an internal combustion engine, situated at the drive-side end (2) of the camshaft (3) and formed of a drive unit (4) that stands in a driven connection with the crankshaft and an output unit (5) that is connected in rotationally fixed fashion with the camshaft (3) is provided. The drive unit (4) stands in a force-transmitting connection with the output unit (5) via at least two pressure chambers (6, 7) formed inside the device (1), the supply of pressure medium to the pressure chambers (6, 7) taking place via a separate distributor housing (8) that has a connecting flange (10) suitable for transmitting pressure medium to the device (1) and a control valve receptacle (9) that is connected to the connecting flange (10) via two pressure medium conduits (11, 12). The output unit (5) is fastened non-positively to the camshaft (3), which passes through the device axially with its drive-side end (2) and has a hollow construction, the end segment (13) of the camshaft (3) being enclosed by the connecting flange (10) of the distributor housing (8) and having a plurality of radial bores (17, 18) that stand in pressure medium connection with additional radial bores (19, 20) in the camshaft (3) via a distributor insert (22) that can be placed into the hollow space (21) of the camshaft (3).

8 Claims, 3 Drawing Sheets

DEVICE FOR THE HYDRAULIC ADJUSTMENT OF THE ANGLE OF ROTATION OF A CAMSHAFT IN RELATION TO A CRANKSHAFT OF AN INTERNAL COMBUSTION ENGINE

BACKGROUND

The present invention relates to a device for the hydraulic adjustment of the angle of rotation of a camshaft in relation to a crankshaft.

From DE 197 45 670 A1, a generic device is known for adjusting the angle of rotation of a camshaft in relation to a crankshaft of an internal combustion engine, said device being situated at the drive-side end of a camshaft mounted in the cylinder head of the internal combustion engine, and formed in principle as a hydraulic actuator that can be controlled dependent on various operating parameters of the internal combustion engine. This device essentially consists of a drive unit standing in a driven connection with the crankshaft via a traction device, as well as an output unit connected in rotationally fixed fashion to the camshaft and surrounded by the drive unit. The drive unit stands in a force-transmitting connection with the output unit of the device via a plurality of pressure chambers formed inside the device, which, upon alternating or simultaneous charging with a hydraulic pressure medium, effect a pivoting movement or fixing of the output unit in relation to the drive unit, and therewith of the camshaft in relation to the crankshaft.

In this device, the supply and conducting away of pressure medium to and from the pressure chambers of the device takes place from the camshaft-remote side of the device, via a separate distributor housing fastened to the cylinder head of the internal combustion engine, having a receptacle suitable for the insertion of an electromagnetic hydraulic valve for controlling the device and having a connecting flange suitable for the transmission of the pressure medium to the device. The receptacle of the hydraulic valve is connected to the connecting flange of the distributor housing via two pressure medium channels situated inside the distributor housing and has a connection to the pressure medium supply and to the pressure medium reservoir of the internal combustion engine.

For the transmission of pressure medium from the connecting flange of the distributor housing to the pressure chambers of the device, the device additionally has a cylindrical pressure medium adapter fastened to the camshaft-remote side of the output unit, formed with an axial through hole and clamped against the device by means of a central fastening screw when the device is screwed onto the camshaft. This pressure medium adapter has on its outer surface two annular grooves that are separated from one another by steel sealing rings that are suitable for the transmission of rotation and that stand in pressure medium connection with the pressure medium channels of the distributor housing, which open into the hollow cylinder of the connecting flange of the distributor housing, when said connecting flange of the distributor housing, formed with said hollow cylinder, is placed onto the pressure medium adapter of the device. A plurality of radial bores distributed around the periphery then open from these annular grooves into the axial through hole of the pressure medium adapter, in which, in a known manner, through a coaxially inserted pressure medium guide sleeve the pressure medium is supplied separately to the pressure chambers of the device or is conducted away from these chambers along the screw shaft of the central fastening screw and/or along the wall of the axial through-hole.

However, a disadvantage of this known device is that the pressure medium adapter that is additionally required for the transmission of the pressure medium is formed as a relatively expensive rotation transmitting part which, due to its constructive design, can be manufactured with high precision only through machining methods. However, such machining methods cause relatively long machine cycle times, and the required tools and apparatus, as well as the material used, result in a considerable manufacturing expense which in the end has turned out to be uneconomical and results in high manufacturing costs for the device. In addition, the pressure medium adapter fastened to the camshaft-remote side of the device increases the axial constructive length of the valve train of the internal combustion engine in such a way that in certain internal combustion engines such a supply of pressure medium to the device cannot be used due to narrow space conditions in the engine compartment of the corresponding vehicle.

SUMMARY

The objective of the present invention is therefore to provide a device for the hydraulic adjustment of the angle of rotation of a camshaft in relation to a crankshaft of an internal combustion engine in which the production outlay and the manufacturing costs for the device are reduced to a minimum through a simplified construction for the transmission of pressure medium from the distributor housing to the device, and in which a lengthening of the axial constructive length of the valve train of the internal combustion engine is avoided to the greatest possible extent.

According to the present invention, this objective is achieved in that the output unit of the device is fastened non-positively, positively, or by a material bond to a segment of the camshaft, which camshaft passes axially with its drive-side end through the device and has a hollow construction at least at this end, the end segment of the camshaft protruding from the device being enclosed by the connecting flange of the distributor housing and having radial bores that are connected with the pressure medium conduits in the connecting flange, said bores standing in pressure medium connection, via a distributor insert that can be placed into the hollow space of the camshaft and arrested there in rotationally fixed fashion, with additional radial bores that are connected to pressure medium conduits in the output unit.

In a useful development of the device according to the present invention, the distributor insert that can be placed into the hollow space of the camshaft is preferably formed as a cylindrical injection-molded part made of a temperature-resistant plastic; however, it is also possible for the distributor insert to be made for example from steel or from other suitable materials. This distributor insert has an outer diameter that corresponds to the inner diameter of the hollow camshaft, so that it is ensured that it can be placed precisely into the camshaft, and that the sealing of the individual annular channels on the distributor insert against one another can be accomplished without additional sealing means via the resulting sealing gap to the inner wall of the camshaft.

In addition, the cylindrical distributor insert for the device according to the present invention is distinguished in that this insert is formed with inner and outer pressure medium channels as well as with peripheral annular channels that stand in effective connection with the radial bores in the camshaft. The inner pressure medium channel in the distributor insert is formed by an axial base bore, from whose ends a plurality of radial bores open into two of the peripheral annular channels on the distributor insert. In contrast, the outer pressure medium channel on the distributor insert is preferably formed as a reduction in the diameter on the jacket surface thereof, making a transition, as an axial limit, to two additional peripheral annular channels on the distributor insert.

In addition, in a further construction of the device according to the present invention the arresting of the distributor insert in the hollow space of the camshaft takes place via a clamping screw that can be screwed into the end of the camshaft formed with an inner threading, which clamps the distributor insert against an axial stop in the hollow space of the camshaft and whose screw shaft simultaneously seals the opening of the axial base bore of the inner pressure medium channel in the distributor insert so as to be sealed against pressure medium. The axial stop in the camshaft is preferably formed by a correspondingly placed local deformation of the camshaft, formed for example as a peripheral necking or as an indentation at a local point of the wall of the hollow camshaft. Because such a local deformation of the camshaft inside the camshaft forms in any case a radius as a stop surface, it is additionally advantageous to form the end surface of the distributor insert adjacent to this deformation with a peripheral beveling that can be formed during the injection molding of the distributor insert, in order to optimize its seating on the local deformation of the camshaft. However, instead of a local deformation of the camshaft, which, due to the fact that it has to be placed immediately before the device at the camshaft-proximate side thereof, requires a first radial bearing of the camshaft to be placed in the cylinder head of the internal combustion engine, it is also possible to form the axial stop in the hollow space of the camshaft by other suitable means, for example by a pressed-in intermediate wall, or in general by situating the end of the hollow space at the corresponding location, so that the first radial bearing of the camshaft can be formed standardly by a wall of the cylinder head of the internal combustion engine.

As an alternative to the above-described fastening of the distributor insert in the camshaft, in an advantageous construction of the device according to the present invention it is further proposed to arrest the distributor insert in the hollow space of the camshaft by a screw part that is formed onto the end surface of the insert remote from the device, and that has a terminating screw head, and that can be screwed into the end of the camshaft formed with an inner threading. Such an arresting of the distributor insert makes an axial stop in the hollow space of the camshaft no longer necessary, so that in this specific embodiment of the distributor insert the cylinder head wall of the internal combustion engine can be fundamentally formed as a first radial bearing of the camshaft. Likewise, in a distributor insert constructed in this way the peripheral beveling of its end surface proximate to the device can be omitted, while on the other hand the opening of the axial base bore of the inner pressure medium channel in the distributor insert must subsequently be sealed tight against pressure medium by an additional stopper.

In a further advantageous construction of the device according to the present invention, the screw head of the clamping screw of the distributor insert or the screw head of the screw part formed onto the distributor insert is simultaneously formed as a part of the axial bearing of the camshaft. In this way, further cost savings can be achieved in the production of the camshaft, because the camshaft need be formed only with one axial bearing part that limits one axial direction, while the other axial bearing part, limiting the second axial direction, is formed by the screw head when the distributor insert is placed into the camshaft. In addition, it is also possible to integrate an additional function of the camshaft adjustment system into the screw head of the clamping screw and/or of the formed-on screw part, by an additionally or optionally at the same time forming it as a pulse trigger or emitter wheel for a pulse reading device for determining the camshaft position in relation to the crankshaft position. For this purpose, a plurality of web-shaped reading marks are formed onto the screw head that extend radially away therefrom and that stand in effective connection with a sensor situated opposite the screw head. However, for a precise adjustability of the reading marks in relation to a second trigger wheel fastened to the crankshaft, it can also be advantageous to form the trigger wheel as a separate part and to clamp it against the end surface of the camshaft with the screw head of the clamping screw and/or of the formed-on screw part.

Finally, as a final feature of the device according to the present invention it is further proposed to form the hollow camshaft, at a segment of the camshaft situated before the distributor insert in the hollow space thereof, with a plurality of radial openings that are preferably formed as a series of cross-bores that are distributed uniformly around the periphery and that open into the hollow space of the camshaft. These radial openings are provided as runoff channels for leakages of pressure medium that exit between the distributor insert and the camshaft, and are placed on the camshaft in such a way that the pressure medium leakages that collect in the hollow space of the camshaft flow off directly into the cylinder head of the internal combustion engine. However, instead of a series of cross-bores distributed uniformly around the periphery of the camshaft, other suitable runoff channels for the pressure medium leakages are also conceivable, for example individual cross-bores, axially offset to one another, that open into the hollow space of the camshaft, or the like, situated such that they support the lubrication of the valve train of the internal combustion engine.

The device according to the present invention for the hydraulic adjustment of the angle of rotation of a camshaft in relation to the crankshaft of an internal combustion engine therefore has the advantage over the devices known from the prior art that the transmission of pressure medium from the distributor housing to the device is significantly simplified by the distributor insert formed as a plastic injection-molded part and capable of being placed into a hollow camshaft, thus reducing the production outlay and the manufacturing costs for the device to a minimum. The direct non-positive, positive, or materially bonded fastening of the device on the camshaft also contributes to an additional reduction of costs for the device, by which the otherwise standard central fastening screw for the device can be omitted. In addition, it is a further advantage of the device according to the present invention that the transmission of pressure medium from the distributor housing to the device via the distributor insert situated in the hollow camshaft requires only an insignificant lengthening of the axial constructive length of the valve gear of the internal combustion engine, because the distributor housing directly encloses the end of the camshaft, and can thus be situated immediately before the camshaft-remote side of the device, inside a chain chamber that in most cases is present anyway in the cylinder head of the internal combustion engine. It is also possible to form the distributor housing not as a separate component but rather as a component integrated into the cylinder head of the internal combustion engine. Likewise, the integration of the function of an axial bearing part of the camshaft and/or of a pulse or trigger wheel into the screw head of the clamping screw of the distributor insert and/or into the screw head of the screw part formed onto the distributor insert is to be noted as a cost-reducing advantage of the device according to the present invention.

BRIEF DESCRIPTION OF THE DRAWINGS

In the following, the present invention is explained in more detail on the basis of an exemplary embodiment and is shown schematically in the associated drawings.

DETAILED DESCRIPTION OF THE PREFERRED EMBODIMENTS

Figure 1:
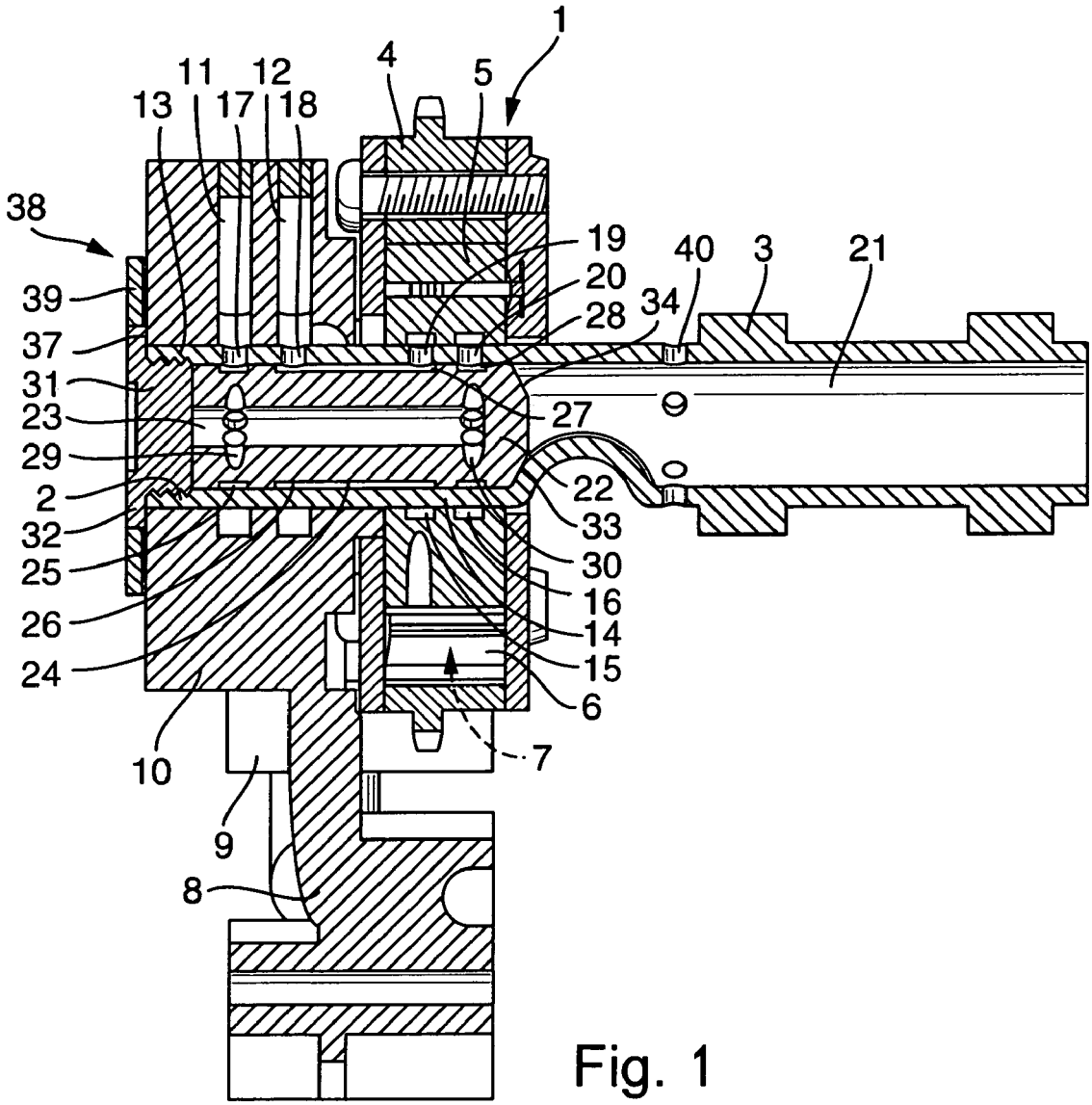
FIG. 1 is a cross-section through a device according to the present invention with a first specific embodiment of a pressure medium distributor insert placed into a hollow camshaft.
Figure 2:
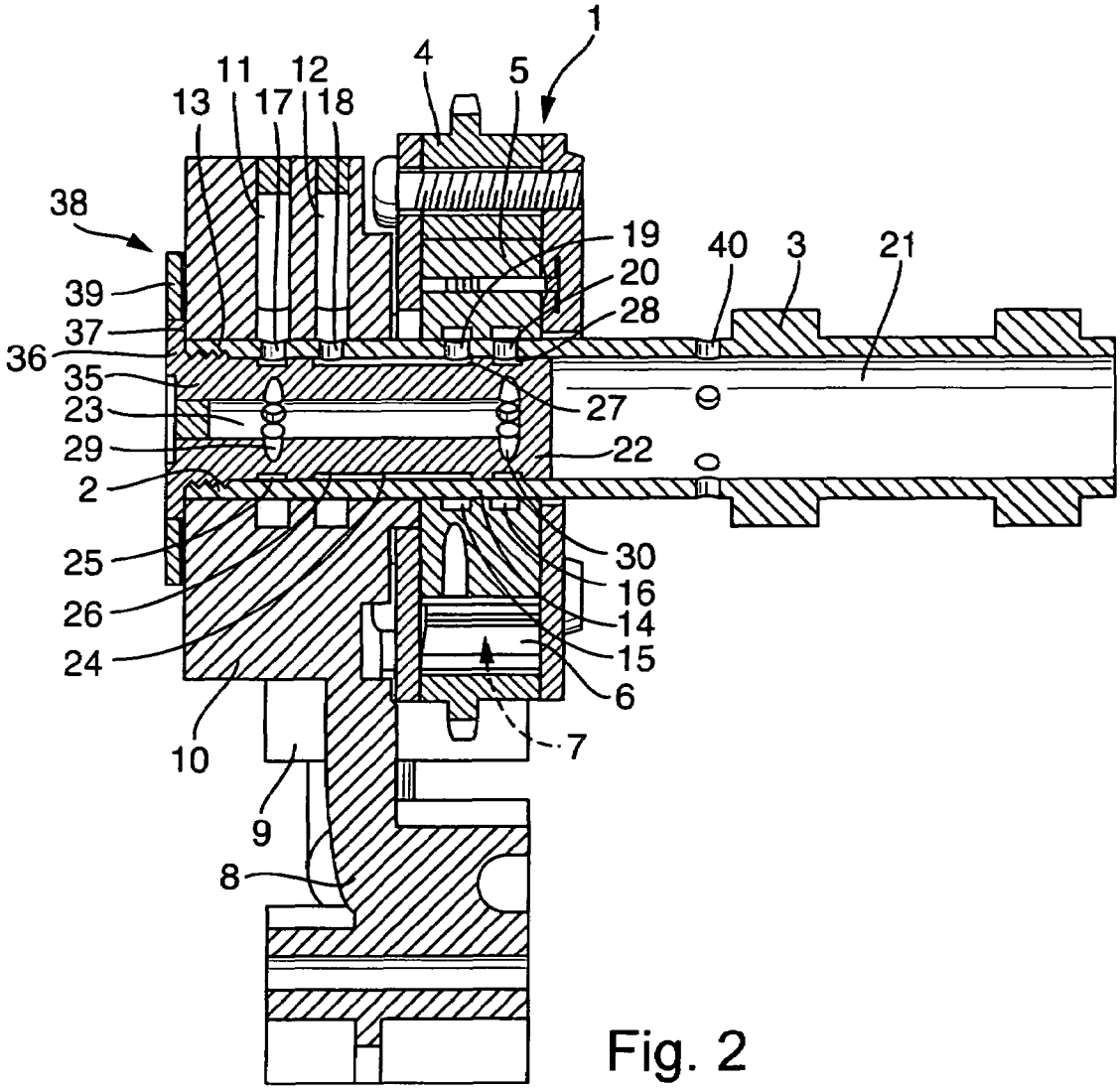
FIG. 2 is a cross-section through a device according to the present invention with a second specific embodiment of a pressure medium distributor insert placed into a hollow camshaft.

FIGS. 1 and 2 clearly indicate a device 1 for the hydraulic adjustment of the angle of rotation of a camshaft 3 in relation to a crankshaft (not shown) of an internal combustion engine that is situated on the drive-side end 2 of camshaft 3 mounted in the cylinder head of the internal combustion engine, formed in principle as a hydraulic actuator that can be controlled dependent on various operating parameters of the internal combustion engine. This device 1 is made up essentially of a drive unit 4 standing in a driven connection with the crankshaft via a traction device, as well as an output unit 5 connected in rotationally fixed fashion to camshaft 3 and surrounded by drive unit 4. The drive unit 4 stands in a force-transmitting connection with output unit 5 of the device 1 via a plurality of pressure chambers 6, 7 formed inside the device 1, which, upon alternating or simultaneous charging with a hydraulic pressure medium, effect a pivoting motion or a fixing of the output unit 5 in relation to the drive unit 4, and therewith of the camshaft 3 in relation to the crankshaft.

Figure 3:
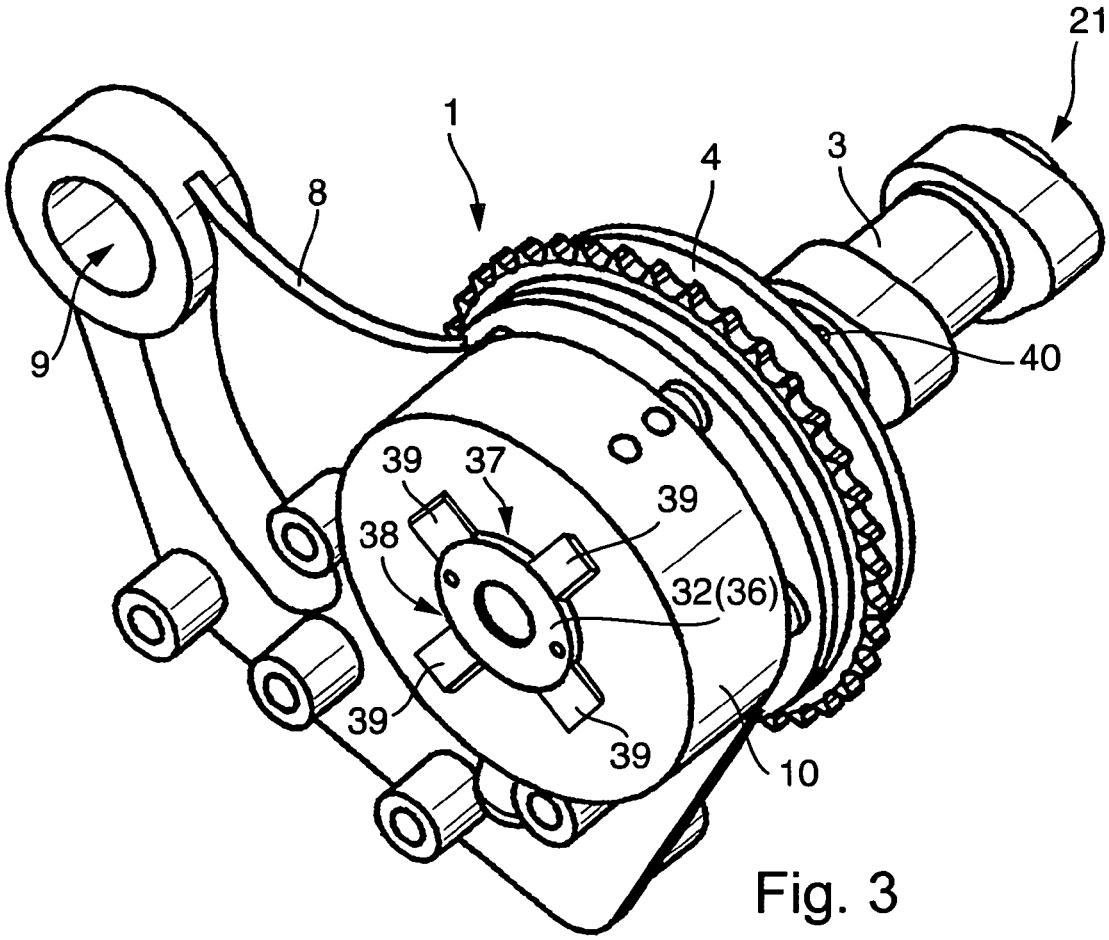
FIG. 3 is a view showing a spatial representation of a device according to the present invention assembled to the camshaft and of a pressure medium distributor housing enclosing the end of the camshaft.

In addition, it can be seen from FIGS. 1 and 2 that the supplying and conducting away of pressure medium to and from the pressure chambers 6, 7 of the device 1 takes place from the camshaft-remote side of the device 1 via a separate distributor housing 8 fastened to the cylinder head of the internal combustion engine, which, as FIG. 3 shows particularly clearly, has a receptacle 9 suitable for the insertion of an electromagnetic hydraulic valve for the controlling device 1 and a connecting flange 10 suitable for the transmission of pressure medium to the device 1. the receptacle 9 is connected to the connecting flange 10 via two pressure medium channels 11, 12 that are situated inside the distributor housing 8 and are only indicated in FIGS. 1 and 2, and has a connection (not visible in the drawings) to the pressure medium supply and to the pressure medium reservoir of the internal combustion engine.

In addition, the cross-sections shown in FIGS. 1 and 2 through the device 1 and through the distributor housing 8 also make it clear that for the simplified realization of the transmission of pressure medium from the distributor housing 8 to the device 1, according to the present invention the output unit 5 of the device 1 is fastened non-positively, by a widening of the camshaft 3, to a segment 14 of the camshaft 3, whose drive-side end 2 passes through the device 1 axially and which has a hollow construction. End segment 13 of the camshaft 3, protruding from the device 1, is completely enclosed by the connecting flange 10 of the distributor housing 8, and has radial bores 17, 18 that are connected with the pressure medium conduits 11, 12 in the connecting flange 10 and that stand in pressure medium connection, via a distributor insert 22 that can be placed into hollow space 21 of the camshaft 3 and arrested so as to be rotationally fixed therein, with additional radial bores 19, 20 in the camshaft 3 that are connected to the pressure medium conduits 15, 16 in the output unit 5 that lead to the pressure chambers 6, 7 of device 1.

From FIGS. 1 and 2, it can be seen that this distributor insert 22, formed as an injection-molded part from a temperature-resistant plastic, has an outer diameter that corresponds to the inner diameter of the hollow camshaft 3, and is formed with inner and outer pressure medium channels 23, 24, as well as with peripheral annular channels 25, 26, 27, 28, that stand in effective connection with the radial bores 17, 18, 19, 20 in the camshaft 3. It can be seen clearly that the inner pressure medium channel 23 in the distributor insert 22 is formed by an axial base bore from whose ends a plurality of radial bores 29, 30 open into the annular channels 25, 28 on the distributor insert 22. In contrast, the outer pressure medium channel 24 on the distributor insert 22 is formed as a reduction of the diameter of the jacket surface thereof, making a transition, as an axial limit, into the annular channel 26, 27 on the distributor insert 22.

In a first specific embodiment shown in FIG. 1, the arresting of the distributor insert 22 in the hollow space 21 of the camshaft 3 then takes place in such a way that the distributor insert 22 is clamped against an axial stop 33, formed as a local deformation of the camshaft 3 in the hollow space 21 of the camshaft 3, by means of a clamping screw 31 that can be screwed into the end 2, formed with an inner threading, of the camshaft 3, and whose screw shaft simultaneously seals the opening of the axial base bore of the inner pressure medium channel 24 in the distributor insert 22 so as to be tight against pressure medium. Because the local camshaft deformation, formed as an indentation at a local point of the wall of the hollow camshaft 3, forms a radius as a stop surface, the distributor insert 22 additionally has on its end surface adjacent to this deformation a peripheral beveling 34 by which the seating of the distributor insert 22 on the axial stop 33 is improved.

In contrast, in the second specific embodiment shown in FIG. 2, the arresting of distributor insert 22 in the hollow space 21 of the camshaft 3 takes place in such a way that during the injection molding a screw part 35 formed with a terminating screw head 36 is formed onto the device-remote end surface of the distributor insert 22; this screw part is screwed into the end 2, formed with an inner threading, of the camshaft 3. In this way, on the one hand both the axial stop required in the first specific embodiment in the hollow space 21 of the camshaft 3 and also the peripheral beveling 34 on the end surface adjacent to this axial stop of the distributor insert 22 can be omitted; however, on the other hand, in this specific embodiment the opening of the axial base bore of the inner pressure medium channel 24 in the distributor insert 22 must be subsequently sealed so as to be tight against pressure medium by an additional stopper indicated in FIG. 2.

In both of the above-named specific embodiments, the screw head 32 of the clamping screw 31, and/or the screw head 36 of the screw part 35 formed on the distributor insert 22, has additional advantageous functions, in which this part is simultaneously formed as part of the axial bearing 37 of the camshaft 3 and at the same time as a pulse or trigger wheel 38 for a pulse reading device for determining the camshaft position in relation to the crankshaft position. In FIG. 3, it can be seen that for the purpose of forming a trigger wheel 38, a plurality of web-shaped reading marks 39 are formed onto the screw head 32 and/or 36 that extend radially away therefrom, and that stand in effective connection with a sensor (not shown in the drawings) situated opposite the screw head 32, 36.

In addition, the hollow camshaft 3 is formed, on a segment situated before the distributor insert 22 in the hollow space 21 thereof, with a series of radial openings 40, visible in all the Figures, that are distributed uniformly about the periphery, and that are provided as runoff channels for pressure medium leakages exiting between the distributor insert 22 and the camshaft, and that, as can be seen clearly, are placed on the camshaft 3 in such a way that the pressure medium leakages that collect in the hollow space 21 of the camshaft 3 run off directly into the cylinder head of the internal combustion engine.

LIST OF REFERENCE CHARACTERS

1 device
2 end
3 camshaft
4 drive unit
5 output unit
6 pressure chamber
7 pressure chamber
8 distributor housing
9 receptacle
10 connecting flange
11 pressure medium conduit
12 pressure medium conduit
13 end segment
14 segment
15 pressure medium conduit
16 pressure medium conduit
17 radial bore
18 radial bore
19 radial bore
20 radial bore
21 hollow space
22 distributor insert
23 inner pressure medium channel
24 outer pressure medium channel
25 annular channel
26 annular channel
27 annular channel
28 annular channel
29 radial bores
30 radial bores
31 clamping screw
32 screw head
33 axial stop
34 beveling
35 screw part
36 screw head
37 axial bearing
38 trigger wheel
39 reading marks
40 radial openings

The invention claimed is:

1. A device for the hydraulic adjustment of the angle of rotation of a camshaft in relation to a crankshaft of an internal combustion engine, comprising:

a hydraulic actuator that can be controlled dependent on various operating parameters of the internal combustion engine located at a drive-side end (2) of a camshaft (3) mounted in a cylinder head of the internal combustion engine;

the hydraulic actuator including a drive unit (4) that stands in a driven connection with the crankshaft via a traction device, as well as an output unit (5) that is connected in rotationally fixed fashion with the camshaft (3) and is enclosed by the drive unit (4);

the drive unit (4) stands in a force-transmitting connection with the output unit (5) of the device (1) via at least two pressure chambers (6, 7) that are formed inside the device (1) and that can be charged alternately or simultaneously with a hydraulic pressure medium;

supply and conducting away of pressure medium to and from the pressure chambers (6, 7) of the device (1) takes place from a camshaft-remote side of the device (1) via a separate distributor housing (8) that is fastened to the cylinder head of the internal combustion engine;

the distributor housing (8) has a receptacle (9) that is suitable for insertion of an electromagnetic hydraulic valve for controlling the device (1), and a connecting flange (10) that is suitable for transmission of the pressure medium to the device (1);

the receptacle (9) of the hydraulic valve is connected to a connecting flange (10) of the distributor housing (8) via two separate pressure medium conduits (11, 12), and has respective connections to a pressure medium supply and to a pressure medium reservoir of the internal combustion engine;

the output unit (5) of the device (1) is fastened non-positively, positively, or by a material bond to a segment (14) of the camshaft (3), which passes axially through the device with the drive-side end (2) thereof and has a hollow space at least at the drive-side end (2);

an end segment (13) of the camshaft (3) protruding from the device (1) being enclosed by the connecting flange (10) of the distributor housing (8) and having radial bores (17, 18) that are connected to the pressure medium conduits (11, 12) in the connecting flange (10);

said bores standing in pressure medium connection, via a distributor insert (22) that placed into the hollow space (21) of the camshaft (3) and arrested therein in a rotationally fixed fashion, with additional radial bores (19, 20) that are connected to pressure medium conduits (15, 16) in the output unit (5).

2. The device according to claim 1, wherein the distributor insert (22) placed into the hollow space (21) of the camshaft (3) is formed as a cylindrical injection-molded part made of a temperature-resistant plastic, and has an outer diameter that corresponds to an inner diameter of the hollow camshaft (3).

3. The device according to claim 2, wherein the cylindrical distributor insert (22) is formed with inner and outer pressure medium channels (23, 24) as well as with peripheral annular channels (25, 26, 27, 28) that stand in effective connection with the radial bores (17, 18, 19, 20) in the camshaft (3).

4. The device according to claim 3, wherein the inner pressure medium channel (23) in the distributor insert (22) is formed by an axial base bore from having ends from which a plurality of radial bores (29, 30) open into the annular channels (25, 28) on the distributor insert (22), and the outer pressure medium channel (24) in the distributor insert (22) is formed as a reduction in a diameter on an outer surface thereof that makes a transition, as an axial limit, to the annular channels (26, 27) on the distributor insert (22).

5. The device according to claim 2, wherein the cylindrical distributor insert (22) is clamped against an axial stop (33) in the hollow space (21) of the camshaft (3) that is formed as a local deformation of the camshaft, by a clamping screw (31) that can be screwed into the end (2) of the camshaft (3), which is formed with an inner threading.

6. The device according to claim 5, wherein a screw head (32, 36) of the clamping screw (31) of the distributor insert (22) or of the screw part (35) formed onto the distributor insert (22) is formed simultaneously as a part of an axial bearing (37) of the camshaft (3) and/or as a pulse or trigger wheel (38) for a pulse reading device for determining a position of the camshaft in relation to the position of the crankshaft.

7. The device according to claim 2, wherein the cylindrical distributor insert (22) can be arrested in the hollow space (21) of the camshaft (3) by an integrated screw part (35), having a terminating screw head (36), that is formed onto a device-remote end surface of the distributor insert and that can be screwed into the end (2) of the camshaft (3), which is formed with an inner threading.

8. The device according to claim 1, wherein the hollow camshaft (3) includes, on a segment positioned before the distributor insert (22), a series of radial openings (40) that are distributed uniformly around a periphery thereof and that are provided as runoff channels for pressure medium leakages that exit between the distributor insert (22) and the camshaft (3).

* * * * *